United States Patent [19]

Novakovic et al.

[11] Patent Number: 4,612,136

[45] Date of Patent: Sep. 16, 1986

[54] SURFACTANT COMPOSITIONS AND RELATED PROCESSES AND PROCEDURES

[75] Inventors: Mario Novakovic, Kew Garden Hills, N.Y.; Phillip G. Abend, Fairlawn, N.J.

[73] Assignee: Finetex, Inc., Elmwood Park, N.J.

[21] Appl. No.: 720,071

[22] Filed: Apr. 3, 1985

[51] Int. Cl.[4] ..... C11D 17/00

[52] U.S. Cl. ..... 252/134; 252/108; 252/121; 252/122; 252/557; 252/DIG. 14

[58] Field of Search ..... 252/108, 121, 122, 134, 252/174, 550, 557, DIG. 4, DIG. 14, 367, 368, 369

[56] References Cited

U.S. PATENT DOCUMENTS

| | | | |
|---|---|---|---|
| 4,156,707 | 5/1979 | Joshi | 252/134 |
| 4,231,904 | 11/1980 | Machin | 252/121 |
| 4,335,025 | 6/1982 | Barker et al. | 252/550 |
| 4,405,492 | 9/1983 | Nyquist et al. | 252/DIG. 16 |
| 4,517,107 | 5/1985 | Clarke et al. | 252/108 |

*Primary Examiner*—Paul Lieberman
*Assistant Examiner*—Hoa Van Le
*Attorney, Agent, or Firm*—Peter L. Berger

[57] ABSTRACT

A surfactant composition comprising an aqueous solution of an alkali metal salt of a fatty acyloxy alkane sulfonate and a polyol; a cleansing combination of this surfactant composition and neat soap and the processes of preparing both the surfactant composition and the cleansing combination thereof.

13 Claims, No Drawings

SURFACTANT COMPOSITIONS AND RELATED PROCESSED AND PROCEDURES

BACKGROUND OF THE INVENTION

1. Technical Field

This invention relates to aqueous surfactant solutions and to a combination thereof with neat soap to form cleansing bars and the like. This invention relates, too, to a process for achieving these compositions.

2. Background Art

The dispersing and emulsifying capacity of conventional soaps and, more particularly, the alkali metal salts of long-chain monocarboxylic or fatty acids, is impaired in hard water due to the tendency of the soaps to form calcium and magnesium salts of the fatty acids that reduce the cleansing power of the soaps and form an adhering, greasy precipitate in sinks, bathtubs and the like. Soaps used in hard water also evidence a persistent undesired adhesion to the skin of the user. Soaps, too, in hard or soft water, tend to irritate sensitive membranes such as those of the eye.

To overcome these shortcomings, synthetic detergent bars have been developed but these bars are not usually capable of processing with conventional soap making equipment; nor do they have the smooth, pleasant texture of soap. Further, these detergent bars are quickly used up due to their high water solubility.

Combination cleansing compositions in bar form, prepared from mixtures of soap and detergent, have been developed heretofore in an attempt to secure the preferred properties of soap and detergent while attempting to eliminate their adverse effects. It has, however, proven difficult to attain these objectives.

A preferred detergent employed and heretofore, for this purpose, has been sodium cocoyl isethionate, also known as "SCI". SCI is a popular lime soap dispersant. It is mild and well tolerated by those allergic to conventional soaps. SCI is commonly used in syndet bars to impart mildness, better rinsibility, and to eliminate hard water resistance and deposits, such as the adhesion of calcium and magnesium salts to tubs, sinks and skin.

The incorporation of SCI into soap bars, and into shampoos and cosmetic emulsions, where it is also used, has involved commercially, weigh-in of the desired proportions of soap, SCI in solid particulate form and homogenization by mechanical agitation of the mixture with the usual additives.

Where employed in conventional soap bar manufacture, more particularly, SCI is added as a fine particulate solid to the almagamator containing soap pellets or chips, known as the soap base. The SCI, in this fine particulate phase, is, however, a sternutatory, lacrimatory and tussive agent, and tends to be so readily transmitted in the atmosphere as to contaminate other products and compositions made contemporaneously in the same plant environment. While SCI is available in larger particle sizes, they are not capable of homogenization in the several processing stages employed in manufacture of combination bars and the like. Further, the homogenization effected, using even reduced proportions of 2 percent to 3 percent of SCI in combination bars, has not been satisfactory, in that the SCI remains detectable, the SCI and soap having different degrees of solubility that cause a grittiness or "sandy feel" in the product bar.

Were it possible, therefore, to provide a smooth, consistent, homogenous, combination detergent and soap bar in which the rate of solubility of the component detergent and soap is substantially integrated and in which the grittiness or "sandy feel" is, as a result, removed, and in which, at the same time, the proportions of detergent and soap may be varied widely without adverse effect, a significant advance in the state of the art would be achieved. If, in addition, the processibility of the product bar were improved, the advance would be even more material.

SUMMARY OF THE INVENTION

Accordingly, the present invention relates to an improved aqueous detergent solution, its use in combination soap and detergent bars and the like and processes for forming these compositions. More particularly, the present invention relates to an aqueous solution of an alkali metal acyloxy alkane sulfonate and a solubilizing agent therefor and to a combination of the foregoing aqueous solution with an alkali metal salt of one or more fatty acids. This latter combination is characterized by its substantial homogeniety, forming, as a consequence of the process described herein, a single liquid and solid solution or sosoloid. It is believed that the solid solution of the soap and detergent bars prepared herein is an anisotropic sosoloid.

The surfactant composition of the invention is prepared by admixture of an alkali metal acyloxy alkane sulfonate with a polyol in an aqueous medium, heating of the mixture so formed above the boiling point of water at superatmospheric pressure in a closed container for a period sufficient to yield, upon cooling, a solid reversible colloidal solution.

The combination detergent and soap solution of the invention is produced, in turn, by a process that involves the batch, or preferably, continuous introduction of a heated liquid or molten solution of the foregoing surfactant solid solution and molten neat soap into admixture, preferably and conveniently, upon completion of the saponification step in which the neat soap is formed. The resulting solution is then transmitted through any of the known kettle or continuous soap-making processes including a continuous removal of substantial moisture content from the integrated solution to form a detergent soap base combination in the form of an anisotropic sosoloid.

The concentration of moisture in the soap/detergent bars of the invention is desirably about 10 percent of the total composition. It is noted that "parts" and "percentages", as these terms are employed herein, refer to parts or percentages by weight, unless otherwise expressly indicated.

A particular advantage of the detergent compositions of the invention is the high concentration of surfactant that may be incoroporated therein, their thermal stability, low melting point, and a moisture content similar, or identical if desired, to that of neat soap providing for versatile application of this surfactant compositions in the soap and cosmetic industries. A particular advantage in the soap and detergent field is the attainment of a significantly improved surfactant/soap combination bar by a process that readily employs existing soap-making equipment and avoids the inefficiency, relative ineffectiveness and other substantial disadvantages of introducing a solid surfactant in the amalgamator contemporaneously with introduction of the standard additives for coarse mixing and milling with the solid pellets, flakes or the like of soap base previously formed.

DESCRIPTION OF THE PREFERRED EMBODIMENT

The present invention thus relates to an aqueous surfactant solution and gel or sosoloid comprising an acyloxy alkane sulfonate salt of the general formula

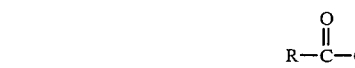

$$R-\overset{\overset{\displaystyle O}{\|}}{C}-O(CH_2)_nSO_3^-M^+ \quad (I)$$

wherein R is a hydrocarbyl radical, desirably from 6 to 26 carbon atoms, n is an integer of from 2 to 4, and M is an alkali metal, and more particularly, sodium, potassium or lithium, and a water-soluble polyol, as a solvent for the sulfonate.

The foregoing surfactant composition, in order to provide a solid reversible colloidal solution or sosoloid at room temperature, that may be utilized in forming detergent/soap bars and the like, as described hereinafter, is prepared by admixture of the solid particulate sulfonate salt with a polyol and water and heating thereof initially at a temperature of 60° C. to 80° C. for a period sufficient to dissolve the solid sulfonate illustratively, 10 minutes to 30 minutes, in an enclosed vessel. The contents of the vessel, including an alkali metal hydroxide, e.g. KOH, incorporated to react with unreacted fatty acids present in the sulfonate salt, are then further heated at a temperature of from 100° C. to 120° C. and for a period desirably of 30 minutes to 120 minutes at superatmospheric pressure, preferably 4 to 10 psig to provide, upon cooling, a sosoloid or reversible hydrogel. The ranges of time, temperature and pressure may be varied and are those sufficient in any event to provide a solid solution at room temperature and one having a concentration of sulfonate salt within the range of about 44 percent to about 56 percent, more desirably of about 48 percent to about 52 percent and preferably about 50 percent of the total contents of the solid colloidal solution obtained. The water content of the solution is maintained, substantially constant during the treatment stage.

The solids content of the gel or solution is normally within the range of about 58 percent to about 72 percent, and more desirably 60 percent to 65 percent, and includes the sulfonate salt as aforesaid as well as unreacted fatty acids and salts present with the incorporated sulfonate. The solution contains, as well, from about 2 percent to about 6 percent and preferably 3 percent to 5 percent, of polyol, and 26 percent to 36 percent, and more desirably, 32 percent to 35 percent of water.

The foregoing proportions provide, particularly, a solid solution that integrates well with neat soap in providing a homogenous solid solution, to which this invention also relates, and one that when dried in accordance with the invention constitutes a cleansing combination detergent and soap bar of unexpectedly smooth texture and thermal stability in which the advantages of both a soap bar and a detergent bar are jointly realized and the disadvantages in utilization of single soap or detergent component bars are substantially reduced or obviated.

The alkane portion of the sulfonate detergents of formula I for use herein are ethane, propane and butane. The fatty acyl moiety is a hydrocarbyl carbonyl oxy group containing from 6 to 26 carbon atoms ($C_6$–$C_{26}$) for example, hexanoic, octanoic, decanoic, lauric, behenic, palmitic, stearic, myristic, arachidic, oleic, linolenic or linoleic groups and the like, or, and indeed preferably, mixtures of the foregoing as in the particularly preferred alkali metal cocoyl isethionates. A small proportion of mono- or di-unsaturated fatty acid derivatives is desirable to provide adequate foaming and solubility correlative to that of the neat soap with which the sulfonate-containing solution is to be mixed in a particularly preferred embodiment. Normally the degree of unsaturation will not be less, when measured by iodine number, than about 2 or more than 12. It will be observed in this context that the term "hydrocarbyl" is intended to embrace linear and branched aliphatic radicals that include alkyl, alkenyl and alkadienyl moieties. Too large a proportion of unsaturation, however, tends to render the sulfonate susceptible to oxidative degradation. For reasons of solubility and avoidance of skin irritation acyl chain lengths of 8 to 20 carbon atoms ($C_8$ to $C_{20}$) are particularly preferred.

The sulfonate salts are prepared conveniently in known manner by, for example, reaction of the desired fatty acid with an alkali metal salt of a hydroxy substituted alkane sulfonic acid. The sulfonic acid reaction product is thus present as its corresponding alkali metal salt. Illustrative fatty acids include $C_6$ to $C_{26}$ fatty acids branched and unbranched, saturated, and mono- and di-unsaturated, and preferably those containing from 8 to 20 carbon atoms ($C_8$ to $C_{20}$). The salts preferably incorporate mixtures of the hydrocarbylcarbonyloxy moieties of acids, such as those derived by reaction with the fatty acids of coconut oil or tallow, and more particularly, beef tallow. The sulfonic acid reactants are hydroxy substituted alkane sulfonic acids such, illustratively, as 2 hydroxyethane sulfonic acid, 3-hydroxypropane sulfonic acid, 2-hydroxybutane sulfonic acid, 4-hydroxybutane sulfonic acid and the like.

The sulfonate salts are also prepared conveniently by reaction of an acyl halide, for example, cocoyl chloride or palmitoyl chloride with an alkali metal hydroxy-substituted alkane sulfonate, illustratively, sodium 2-hydroxy ethane sulfonate (sodium isethionate), sodium 2-hydroxy propane sulfonate, potassium 3-hydroxypropyl sulfonate or lithium 2-hydroxy butane sulfonate.

Illustrative salts and mixtures of surfactant sulfonate salts for use herein are sodium 2-cocoyloxy ethane sulfonate (sodium cocoyl isethionate), sodium 2-cocoyloxy propane sulfonate, sodium 3-cocoyloxy propane sulfonate, sodium 4-cocoyloxy butane sulfonate, sodium 2-palmitoyloxy ethane sulfonate, potasium 2-behenoyloxy ethane sulfonate, and lithium 2-stearoyloxy ethane sulfonate. Sodium cocoyl isethionate ("SCI") is particularly preferred in the practice of the invention. The product sulfonate salts, for example, the preferred sodium cocoyl isethionate ("SCI"), may, without adverse effect, retain relatively small quantities of unmodified reactants, sucn as coconut fatty acid and sodium isethionate, although these should not exceed desirably about 22 percent by weight of the sulfonate reaction product.

The water-soluble polyols for use herein include, for example, ethylene glycol, 1,2-propylene glycol, 1,3-propylene glycol, glycerol, 1,3-butylene glycol, sorbitol, mannitol, glucose, fructose, sucrose, lactose, corn syrup and hydrogenated hydrolyzed corn syrup.

The neat soap employed in producing detergent and soap combinations is prepared by conventional kettle boiling or continuous saponification procedures well known to those skilled in the art to which this invention pertains. So, too, are the finishing steps, including incorporation of additives, to which the neat soap is normally subjected. Indeed, an advantage of the invention is that the standard process steps of soap manufacture can be utilized without interruption while securing a significantly superior combination product.

The neat soap of the invention is prepared from standard sources, including saponification of the naturally occurring triglycerides of animal and vegetable fats and oils, notably, beef tallow and coconut oil, respectively, and mixtures thereof or by the continuous neutralization of free fatty acids derived from the foregoing fats and oils. The preferred cation of these soaps is sodium, but other alkali metals such as lithium and potassium are also desirably employed. A sodium soap prepared from a blend of about 20 percent coconut oil and about 80 percent tallow is generally preferred for use in the toiletry bars contemplated by the invention.

The neat soap, whether saponified from fat, oil or fatty acid, has a soap content of between about 69 percent and about 65.5 percent and about 30.5 percent to about 34 percent respectively of water with a residual salt content of about or less than 0.5 percent.

The proportion of soap to water thus reproduces or is comparable to the concentration of detergent solids to water in the surfactant solution as noted elsewhere herein, and like the latter solution, the surfactant solution has many of the physical properties of the surfactant solid solution with which it is admixed. The foregoing proportions are, however, more representative of sodium-containing soaps than those formed of potassium or lithium. Potassium-containing neat soaps contain, typically, up to about 60 percent of water and as little as about 39.5 percent of saponified product. The neat soap so obtained is, in any event, an anisotropic solution.

While neat soap that has cooled may be introduced into the practice of the invention by heating to a liquid state prior to introduction of the preheated detergent solution, it is most practicable to use the saponified product of a batch or continuous process that is in the molten state and introduce this product into a conventional feed tank or crutcher into which the heated liquid detergent solution is also introduced simultaneously or in sequence, before or after the detergent solution.

The molten neat soap and detergent are agitated together in the feed tank or crutcher of standard construction and containing an agitator, for a period of time sufficient to assure the homogeniety of the admixed solutions.

The resulting solution is next transferred, in a particularly preferred embodiment, to assure the formation of a stable solid solution, to a heat exchanger wherein the detergent soap solution is super-heated to a temperature of about 130° C. to 150° C. and preferably about 150° C. at a pressure of about 3 to 5 atmospheres for a period of from 2 minutes to 4 minutes. The period of residence is not narrowly critical. It is essential that the solution be superheated at a temperature such that the moisture content of the combined soap/detergent solution can be reduced to within a range of about 7 percent to about 15 percent, and most desirably, about 10 percent.

The superheated solution is deposited upon a chilling roll where moisture is flashed off and the soap solidifies and is taken off by knife or scraper and pelletized or ground whereupon the solidified solution of this flash drying process is transferred to the amalgamator of the finishing stage wherein color, fragrences, super-fatting agents, germacides, antioxidants and the like. The amalgamator or batch mixer is one equipped desirably with a helical agitator. The mixture is then spread on a three- or five-roll mill where it is squeezed through the first two rolls, picked up by a more rapidly rotating third or intermediate roll and passed to the final treatment rolls, from the last or fifth roll of which the milled soap is scraped as ribbons. The scraping is accomplished by a series of staggered knives. Each mixer batch of soap is desirably milled twice. Well-known alternative means of mixing and milling soap applicable, as well, to the soap-detergent sosoloids of the present invention involve the homogenization of the coarsely worked pellets or flakes and additives in proportions known to those skilled in the art for use in soap bars and in cylindrical refiners wherein the soap and detergent solid is forced through small orifices and fed to a second refiner or milling operations such as described above.

The mill ribbons or refiner pellets are compressed, extruded to form a log of soap that is cut and cooled to form bars or cakes of the desired length.

Alternative steps available in the manufacture of soap may also be used in the production of toilet soap bars of the invention such as where, for example, the presence of additives or at least their uniform or extensive distribution in the product bar is not considered critical, in which event the soap and detergent solution recovered from the crutcher may be simply deposited in frames where the solution is permitted to cool into solid bars that may be further cut to desired size.

Too, while flash drying through superheating in a heat exchanger constitutes a preferred method in preparing the anisotropic sosoloids of the invention, other methods commonly employed in soap manufacture may also be employed, including box or cabinet drying and vacuum spray drying. In applying a cabinet drying technique to the present application the admixed solution of molten neat soap and detergent solution from the feed tank is dropped onto a chill roll. The solidified ribbons of product formed on the roll are scraped off and dropped onto a wire mesh conveyor belt and transmitted through a warm wind tunnel for a period of time and at a temperature of less than about 50° C. and greater than 35° C., sufficient to reduce the water content of the solid solution preferably to about 10 percent. This process is time consuming and inefficient in energy consumption and in securing a uniform removal of moisture.

Vacuum drying incorporates many of the advantages of the flash drying procedure in that the combined neat soap and detergent solution is pumped through a heat exchanger under temperature and pressure conditions similar to those of the flash drying process. The hot solution having the requisite initial moisture content is then sprayed into the vacuum chamber from which the soap-detergent product with the requisite reduced moisture is scraped mechanically, and collected on a screw for extrusion as a plurality of lumps that are pelletized and then mixed and milled with the usual additives followed by plodding of the desired cakes and bars.

As is evident, while the concentration of water is reduced, the proportions by volume of detergent to soap remain substantially constant throughout the process of formation of the solid solution product.

The proportions of each of these solutions to the other may, however, as a particular advantage made possible by the present invention, be varied over wide limits while providing, illustratively, a toilet soap/detergent bar that is without grit or "sandy feel", that is smooth in texture, the wear properties of which are uniform and improved over that of a conventional syndet bar and in which there is substantially reduced, in the preferred embodiments, adhesion of calcium and magnesium salts to skin and washing facilities where hard water is present. It will be apparent, too, that the cross-contamination of other plant products and the adverse physical effects caused workers in the soap/detergent production unit are obviated by the present invention.

While reference is made particularly to toilet soap/detergent bars the solutions of the invention are useful, as well, in shampoos, emulsions, gels and the like.

Proportions of surfactant or detergent solution to neat soap solution for use herein are found to have particular advantage within of a range of 80 percent to 20 percent and 20 percent to 80 percent respectively of the former to the latter; a more preferred range is that extending from 75 percent to 20 percent and vice versa and most preferred to secure all of the objectives hereof are approximately equal proportions of detergent solution to neat soap of from 60 percent to 40 percent and vice versa.

The following examples are further illustrative of the invention.

EXAMPLE I

A surfactant composition of the present invention was made using the following ingredients.

| Ingredients | Parts by Weight |
|---|---|
| Sodium cocoyl isethionate (sodium 2-cocoyl oxy ethane sulfonate) (flake, commercial) | 1220 |
| Sorbitol 70% aqueous solution | 86 |
| Water | 694 |
| Potassium hydroxide - 45% aqueous solution | 10 |
| | 2010 |

The ingredients were charged, in the order given, to a pressurizable vessel. The mixture was heated to 70° C. The vessel was pressurized with nitrogen to 6 p.s.i.g. and the temperature then raised to 110° C. The contents of the vessel were held at 110° C./6 p.s.i.g. for one hour. The vessel was cooled to 95° C. and the internal pressure allowed to fall slowly to atmospheric pressure. The contents of the vessel are poured off. After cooling to room temperature, the product, a firm white gel or solid of approximately 50% active as sodium cocoyl isethionate, had a melting or liquifaction point of 43° C.–45° C.

EXAMPLE II

The procedure of Example I was repeated using the following components:

| Ingredients | Parts by Weight |
|---|---|
| Sodium cocoyl isethionate (flake, commercial) | 610 |
| Glycerol | 15 |
| 1,2-Propylene glycol | 15 |
| Water | 360 |
| Potassium hydroxide (45% aqueous solution) | 5 |
| | 1005 |

A firm white solid of approximately 50% activity as sodium cocoyl isethionate, having a melting or liquifaction point of 42° C.–44° C., was recovered.

EXAMPLE III

A surfactant composition of the present invention is made using the ingredients, proportions thereof and conditions of Example I but substituting potassium 2-cocoyloxy ethane sulfonate for sodium cocoyl isethionate.

A surfactant composition of the present invention is made using the ingredients, proportions and conditions of Example II but substituting lithium 3-palmitoyloxy propane sulfonate for sodium cocoyl isethionate.

EXAMPLE V

Two hundred kilograms of neat soap in the molten state and including about 70 percent by weight of the sodium salt of coconut ($C_8$ to $C_{18}$) fatty acids, and more specifically 8.0 percent octanoic acid, 7.0 percent decanoic acid, 48.0 percent lauric acid, 17.5 percent myristic acid, 8.8 percent palmitic acid, 2.0 percent stearic acid, 6.0 percent oleic acid, and 2.0 linoleic acid, about 25 percent water, and 5 percent unreacted sodium salts and fatty acids were introduced in the molten stage into a cylindrical feed tank.

Two hundred kilograms of gel or solid detergent solution of Example I (including about 50 percent of sodium cocoyl isethionate, and a total solids content inclusive of said isethionate and unreacted coconut fatty acid and associated salts and the like of about 65 percent ("SCI solution") is heated to a liquid state at about 80° C. and introduced into the feed tank into which the molten neat soap has been previously introduced.

The mixture of molten detergent solution and molten soap solution is admixed in the feed tank by agitators mounted in the tank and including a screw agitator for lifting the mixture from the bottom of the tank and a sweep agitator for lateral stirring.

The mixture is heated in the tank at about 80° C. while being stirred and is then pumped to a heat exchange unit where the SCI solution and neat soap are heated to a temperature of about 150° C. and under a pressure of about 4 atmospheres for a period sufficient to allow the desired temperature rise. This solution is subjected to a flash drying procedure wherein the superheated solution is spread onto a chill roll where the moisture content is reduced to about 10 percent, most desirably.

The resulting solid is removed by scrapers and pelletized. This product, a solid solution or sosoloid of the combined neat soap solution and and surfactant solution, may be finished by introduction into an amalgamator where various additives including colors, fragrances and the like are introduced and coarsely milled with the pelletized combination. The mixture is further blended, compressed and extruded in a plodder to form a log of solid soap which is then cut, stamped or the like, and, if desired, wrapped and cartoned.

EXAMPLE VI

The process of Example V is repeated using a potassium cocoyl isethionate prepared under conditions similar to that used in the preparation of the sodium cocoyl isetheonate of Example II, and admixed with a neat soap in the proportions and employing the method of Example V, but wherein the soap of the neat soap solution is the sodium salt of fatty acids derived from tallow, i.e. 2.0 percent myristic acid, 32.5 percent palmitic acid, 14.5 percent stearic acid, 48.5 percent oleic acid, and 2.7 percent linoleic acid. The homogenous firm, solid solution or sosoloid product secured by flash drying in the manner of Example V may be prepared as a finished combined soap and detergent bar.

It will be evident that the terms "acyloxy alkane sulfonate salt", "sulfonate" and grammatical variations, as well as abbreviations and representative members thereof, employed herein are intended to include those acyloxy alkane sulfonate salts wherein the acyl moiety is a single hydrocarbylcarbonyl group, and indeed preferably, mixtures thereof as characterized in the specification. This characterization applies to the isethionate salts coming within the foregoing definition, as well, for example, sodium cocoyl isethionate.

It will be evident, too, that the terms and expressions that have been employed herein are used as terms of description and not of limitation. There is no intention in the use of these terms and conditions of excluding equivalents of the features shown and described or portions thereof, and it is recognized that various modifications are possible within the scope of the invention claimed.

What is claimed is:

1. A process that comprises admixing an acyloxy alkane sulfonate salt of the formula:

$$R-\overset{\overset{\displaystyle O}{\|}}{C}-O(CH_2)_nSO_3^-M^+$$

wherein R is a hydrocarbyl radical, n is an integer of from 2 to 4 inclusive, and M is an alkali metal, with a polyol and water wherein said sulfonate salt is present in an amount by weight of about 44 percent to about 56 percent, said polyol is present in an amount by weight of about 2 percent to about 6 percent, and water is present in an amount by weight of about 26 to about 36 percent, and heating said mixture under superatmospheric pressure for a period of time sufficient to form, upon cooling, a reversible solid colloidal solution.

2. A process as claimed in claim 1 wherein said sulfonate salt includes salts wherein said hydrocarbyl radical is an alkyl, alkenyl and alkadienyl moiety, and said mixture has an iodine number of less than about 12.

3. A process as claimed in claim 1, wherein said sulfonate salt is the reaction product of a hydroxy substituted alkane sulfonic acid salt and coconut fatty acid.

4. A process as claimed in claim 1 wherein said sulfonate salt is sodium cocoyl isethionate.

5. A process as claimed in claim 1, wherein said polyol is glycerol.

6. A process as claimed in claim 1, wherein said polyol is sorbitol.

7. A process that comprises admixing an acyloxy alkane sulfonate salt of the formula:

$$R-\overset{\overset{\displaystyle O}{\|}}{C}-O(CH_2)_nSO_3^-M^+$$

wherein R is a hydrocarbyl radical, n is an integer of from 2 to 4 inclusive, and M is an alkali metal, with a polyol and water, and wherein said sulfonate salt is present in an amount by weight of about 44 percent to about 56 percent, said polyol is present in an amount by weight of about 2 percent to about 6 percent, and water is present in an amount by weight of 26 to 36 percent, and heating said mixture under superatmospheric pressure to form a first molten solution thereof, admixing said first solution with a second molten neat soap solution, and drying the combination of said first and second solutions to reduce the water content thereof to from about 5 percent to 15 percent by weight.

8. A process as claimed in claim 7, wherein the combination of first and second solutions is cooled upon drying to a sustantially homogenous solid solution.

9. A process as claimed in claim 7, wherein said combination of first and second solutions is dried to reduce the water content thereof to about 10 percent.

10. A process as claimed in claim 7, wherein said salt is sodium cocoyl isethionate.

11. A process as claimed in claim 7, wherein said polyol is sorbitol.

12. A process as claimed in claim 7, wherein said polyol is glycerol.

13. A process as claimed in claim 1, wherein said alkali metal is sodium, lthium or potassium.

* * * * *